United States Patent [19]

Harvey et al.

[11] 4,033,839

[45] July 5, 1977

[54] METHOD FOR SERIES ELECTROWINNING AND ELECTROREFINING OF METALS

[75] Inventors: Walter W. Harvey, Bedford; Myron R. Randlett, Burlington; Karlis I. Bangerskis, Walpole, all of Mass.

[73] Assignee: Kennecott Copper Corporation, New York, N.Y.

[22] Filed: Apr. 14, 1976

[21] Appl. No.: 676,685

Related U.S. Application Data

[60] Division of Ser. No. 553,139, Feb. 26, 1975, Pat. No. 3,979,275, which is a continuation-in-part of Ser. No. 445,435, Feb. 25, 1974, Pat. No. 3,875,041.

[52] U.S. Cl. ..... 204/108; 204/105 R

[51] Int. Cl.[2] ..... C25C 1/12

[58] Field of Search ..... 204/105 R, 108

[56] References Cited

UNITED STATES PATENTS

| | | | |
|---|---|---|---|
| 1,700,178 | 1/1929 | Porzel | 204/277 |
| 3,875,041 | 4/1975 | Harvey et al. | 204/277 |

OTHER PUBLICATIONS

"Princ. of Electroplating & Electroforming", by Blum et al., 3rd Ed., 1949, p. 68.

*Primary Examiner*—R. L. Andrews

*Attorney, Agent, or Firm*—John L. Sniado; Anthony M. Lorusso

[57] ABSTRACT

An electrodeposition cell in which high quality metal such as copper is produced on bipolar electrodes at a high current density. The bipolar electrodes are arranged in series between a cathode and an anode. Current shields around the anode and cathode and each bipolar electrode prevent current bypass. Gas bubble tubes for continuously agitating the electrolyte across each face of the bipolar electrodes enable effective use of high current densities to electrowin or electrorefine a metal such as copper.

Apparatus may include bipolar electrodes comprising a non-corrodible metallic substrate having a refinable metal such as copper on its anodic face.

Current shields also prevent electrodeposition on unwanted areas of bipolar electrodes and end cathode.

Method of electrodeposition with novel cell.

9 Claims, 7 Drawing Figures

COMPOSITE BIPOLAR ELECTRODE

METHOD FOR SERIES ELECTROWINNING AND ELECTROREFINING OF METALS

CROSS REFERENCE TO RELATED APPLICATION

This is a division of application Ser. No. 553,139, filed Feb. 26, 1975, now U.S. Pat. No. 3,979,275, which is a continuation-in-part of application Ser. No. 445,435, filed Feb. 25, 1974, now U.S. Pat. No. 3,875,041.

Application Ser. No. 445,435 is entitled Method and Apparatus for the Electrolytic Recovery of Metal Employing Improved Electrolyte Convection, the teachings of which are incorporated herein by reference.

BACKGROUND OF THE INVENTION

The present invention is related generally to an electrolytic process and apparatus for recovering copper and other metals. The process and apparatus of the present invention are useful in both electrowinning and electrorefining. The present invention is specifically directed to series electrowinning and electrorefining.

In order to facilitate understanding the present invention, a brief discussion relative to electrorefining and electrowinning in a series cell follows. FIG. 1 is a diagram showing the general arrangement upon which a series cell in accordance with the present invention is operated in a refining mode. The fundamental characteristic of any series cell is that a series of bipolar electrodes, 10, 12, 14, 16 and 18 which are unconnected to any electrical circuit, is located between an anode and cathode pair. When the circuitry of the cell is completed, electric current passes from the anode 20 through all the bipolar electrodes in a series to the cathode 22 as is shown by arrow 24. When the cell is in operation, metal is plated on that surface of each bipolar electrode which faces the anode, i.e. cathodic surfaces 26, 28, 30, 32 and 34; metal is etched away from the surface of the bipolar electrode facing the cathode i.e. anodic surfaces 36, 38, 40, 42 and 44. Of course, metal is also deposited on cathode face 46 and removed from the immersed surface of anode 20. At this point, it should be noted that a cell constructed in accordance with the present invention can contain more than the five bipolar electrodes shown in FIG. 1. The number of such bipolar electrodes is a detail which is well within the skill of those in this art.

In connection with the bipolar electrodes used in the cell of the present invention, it should be noted that the cell of the present invention can be operated with a novel composite bipolar electrode such as those shown in FIG. 1 by reference numerals 10, 14 and 18. The concept involved in the composite bipolar electrode structure is to employ a base sheet or substrate of electrochemically suitable material such as titanium or other "valve" metal or stainless steel (S.S.) and affix to it, on one side, a layer of refinable anode material such as copper. Further details of such bipolar electrodes appear below.

Of course, the cell of the present invention can employ conventional dipolar electrodes such as copper slabs or sheets 12 and 16. Due to the electrochemical action within the cell, metal is etched away from the surface of sheets 12 and 16 facing the cathode and is deposited on the surface of sheets 12 and 16 facing the anode so that after operating for a period of time, the positions of sheets 12 and 16 shift to the locations shown by the dotted line pairs in FIG. 1.

When a series electrodeposition cell is employed for electrorefining of a metal such as copper, the anode is a slab of that metal, and the bipolar electrodes can be sheets of the same metal or the novel composite structures described above. A series cell would normally include only one style of bipolar electrode.

When a series cell is used for electrowinning, the anode is an insoluble anode formed of metal such as lead or lead alloy or of precious metal clad titanium, or the like. The bipolar electrodes are then constructed of similarly insoluble materials that allow oxygen evolution at their anodic face while permitting the deposited metal to be stripped from their cathodic face. With both modes, winning and refining, of series electrodeposition, the end cathode may be a starter sheet of the metal to be deposited or, preferably for this invention, a rigid nonretentive blank of stainless steel or titanium or the like.

There are many advantages in utilizing series electrodeposition cells for both electrowinning and electrorefining. Principal among them are the use of much lower cell currents than in the parallel system of electrodeposition and the elimination of electrical contacts to all but the end electrodes of a cell. The advantages of the series system become even greater at very high current densities, where in the parallel system low-resistance clamps are required for every electrode, thus complicating the operation and rendering the attainment of the desired close spacing very difficult.

One disadvantage of utilizing prior art electrodeposition series cells for electrowinning or electrorefining is that the prior art cells were not capable of being efficiently utilized at high current densities; that is, in the case of copper, current densities in excess of 17–20 amps per square feet. In the present invention high current density is advantageously employed to reduce plant size and metal inventory. In connection with the foregoing, the term "current density" is the ratio of current in amperes to the area of cathode in square feet and is expressed in ASF units. Of course, it is well known in this art that an increase in current density decreases the time required for a given amount of metal deposition.

One of the problems associated with prior art electrodeposition series cells is the phenomenon known as "current bypass". When current bypass occurs, a portion of the current does not pass through the bipolar electrodes but passes under or around the bipolar electrodes from the anode to the cathode as is shown by arrow 50. Of course, any current that passes from the anode to the cathode bypassing the bipolar electrodes will not contribute toward plating metal on the bipolar electrodes. Accordingly, any efficient series cell must have some means in it for reducing current bypass.

The most significant problem associated with the prior art means for blocking out current bypass is that the means for blocking out the current bypass do not allow for sufficient convection of the electrolyte. In connection with the foregoing, convection is necessary to prevent stagnation of the electrolyte, which results in depletion of the depositing metal ions at cathodic surfaces and may result in passivation of soluble anode surfaces.

SUMMARY OF THE INVENTION

The present invention is a method and apparatus for series electrowinning and electrorefining which employs shields to block current bypass but which also includes an air agitation system to provide the necessary convection to prevent stagnation of the electrolyte.

Accordingly, it is an object of the present invention to provide a series electrodeposition method and apparatus which enable the electrodeposition of metal at current densities which are high in relation to the metal concentration, while producing metal of acceptable purity and mechanical integrity.

A further object of the present invention is to provide a novel method and apparatus for effecting vigorous electrolyte convection in a series electrodeposition process.

A further object of the present invention is to provide a series electrodeposition cell which includes a convection system and insulating shields completely enclosing the ends of the bipolar electrodes and shields for blocking current bypass.

A further object of the present invention is to provide an improved method and apparatus for the series electrorefining of metal.

A further object of the present invention is to provide an improved method and apparatus for the series electrowinning of metal.

Another object of the present invention is to provide a method and apparatus for series electrodeposition which employs a removable rack which can be loaded with the electrodes remotely from the cell.

A further object of the present invention is to provide a method and apparatus for series electrorefining of a metal such as copper which can employ composite bipolar electrodes having a layer of impure metal, such as copper, affixed to a permanent blank.

Another object of the present invention is to provide an electrodeposition method and an electrodeposition cell which obviate the need for workers to spend time in the vicinity of operating cells, where they may be exposed to acid mist and to uncomfortable high temperatures and humidity.

Another object of the present invention is to eliminate systems work associated with electrodeposition cells for providing positive positioning of electrodes ad favorable mass transport conditions at the cathodes.

A further object of the invention is to provide an electrodeposition method and a series electrodeposition cell in which electrical shorts due to misalignment, warping and bowing of electrodes and nodular or dendritic proturbances on the cathode are suppressed.

DESCRIPTION OF THE PREFERRED EMBODIMENTS

Figure 2:
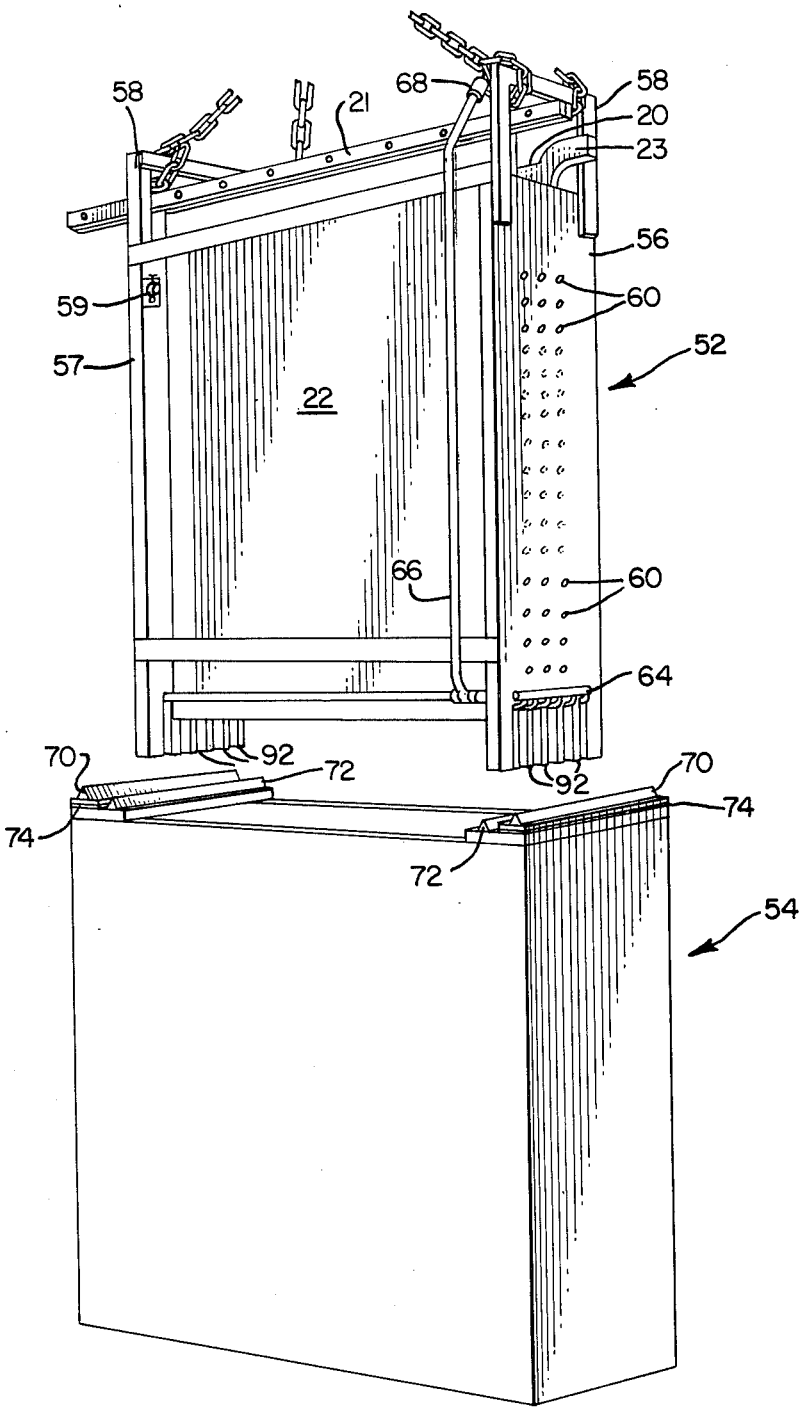
FIG. 2 is a perspective view of a conveyable rack of the present invention being lowered into an electrodeposition tank.

At the outset, the invention is described in its broadest overall aspects with a more detailed description following. As is best shown in FIG. 2, the assembly of the present invention includes a conveyable rack 52 which can be lowered into an electrolyte tank 54. As will become more apparent from the discussion which follows, a major advantage of the cell of the present invention is that it obviates the need for workers to spend time in the vicinity of operating cells where they may be exposed to acid mist and to high temperature and humidity. Because the conveyable rack can be loaded with electrodes and unloaded at a point remote from tank 54, there is no need for the operator to load and unload the electrodes directly into the tanks.

In accordance with the present invention, conveyable rack 52, once assembled, can be transported by a suitable transporting device (not shown) and lowered into a tank 54 filled with electrolyte. To aid in transporting the conveyable rack 52, the rack is inclusive of a pair of holes on each side 56 and 57. Removable hangers 58 have posts that slide into these holes to facilitate lifting conveyable rack 52. In FIG. 2, post 59 is shown protruding through side 57 of the conveyable rack.

Because the rack is inclusive of current shields and electrode guides it is not necessary for an operator to remain by the cell to check for electrical shorts due to misalignment and warping and bowing of the electrodes.

The conveyable rack 52 is formed of a material that can withstand the corrosive environment of the electrolyte. One suitable material for forming conveyable rack 52 is polyvinyl chloride (PVC). The various nuts and bolts 60 used to assemble the conveyable rack are also formed of polyvinyl chloride or of stainless steel where needed.

The cell of the present invention is inclusive of stainless steel bubble tubes 62 on a manifold 64. It is preferred that the cell contain one bubble tube for each interelectrode space, defined by opposing electrode faces and the walls of the conveyable rack. The end of the air inlet pipe 66 for the manifold projects out of the electrolyte and terminates with a quick connect fitting 68 for connection to a supply of moist air.

The conveyable rack shown in the drawing can be used for either or both electrowinning and electrorefining, the essential differences between the two modes of electrodeposition residing mainly in the nature and construction of the electrodes as is well known to practitioners of the art.

Figure 3:
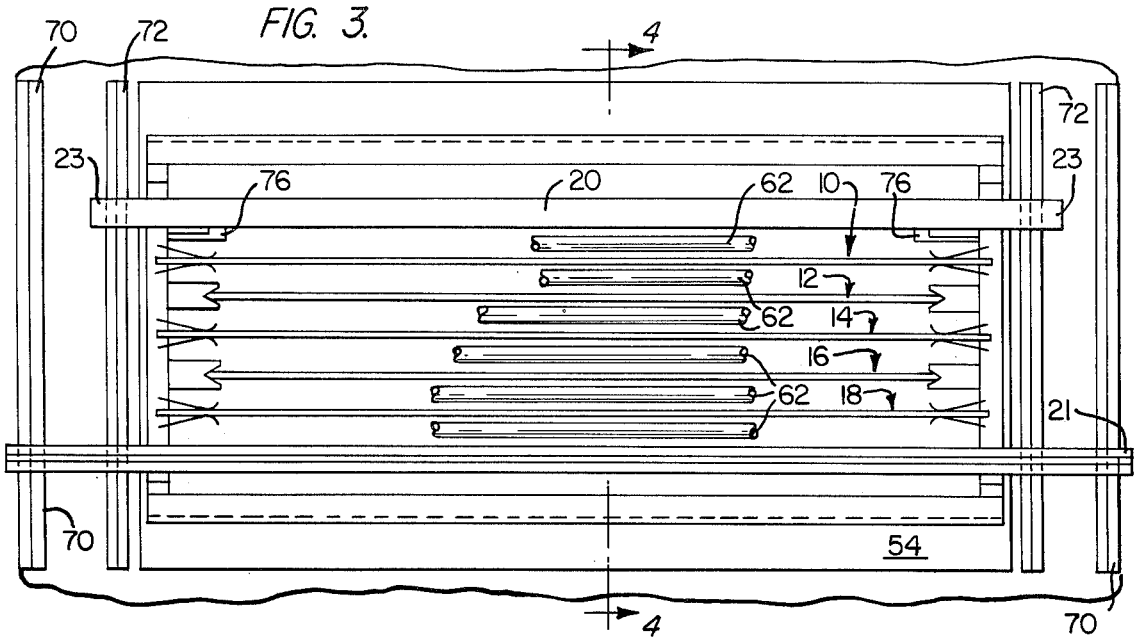
FIG. 3 is a plan view of the conveyable rack of FIG. 2 in position in the tank.
Figure 5:
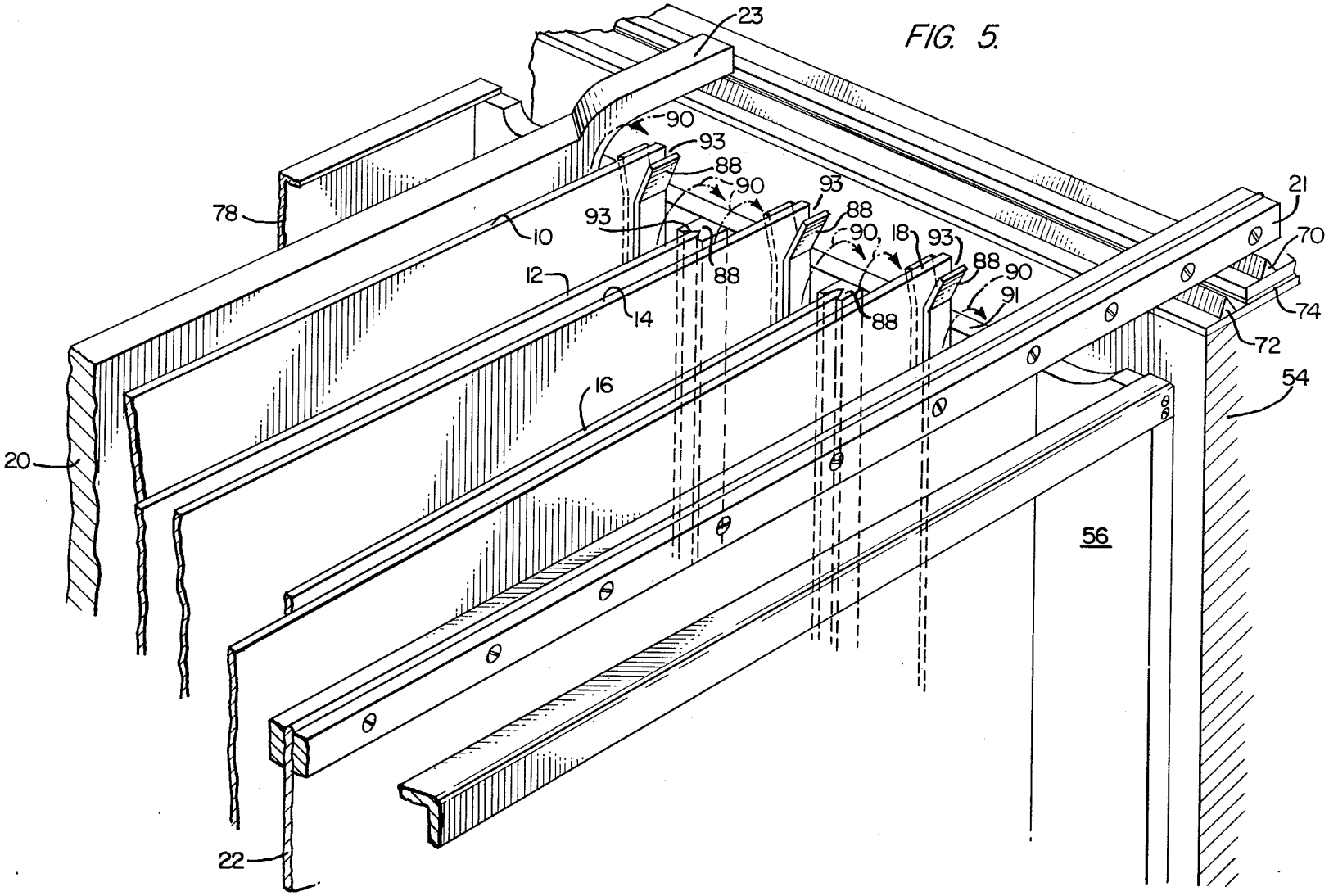
FIG. 5 is a perspective view of a top portion of a conveyable rack and tank of the present invention.

As is best shown in FIGS. 2, 3 and 5, the tank 54 is inclusive of cathode current supply bars 70 and anode current supply bars 72 separated by an insulator 74. When a properly loaded conveyable rack 52 is positioned in tank 54, cathode suspension bar 21 contacts the two negative polarity current supply bars 70 and the anode lug or suspension bar 23 contacts the two positive polarity current supply bars 72.

For a copper electrorefining embodiment of the present invention, it is advantageous to form anode 20 out of refinable copper and to utilize a stainless steel or other non-retentive cathode blank. As is shown in FIGS. 3 and 5 for this embodiment, bipolar electrodes 10, 12, 14, 16 and 18 are positioned within the cell so that no direct electrical contact is made with the current supply bars or with the end anode and the end cathode. When the cell is in operation, current flows from the end anode to the end cathode through the bipolar electrodes.

To eliminate current bypass and to provide proper alignment, the conveyable rack is inclusive of current shields and electrode guides.

For example, the conveyable rack is inclusive of an anode current shield 76 which runs along the bottom and up the two sides 56, 57 of the rack on the face of the anode nearest bipolar electrode 10. The end wall 78 of the conveyable rack is a solid sheet of polyvinyl chloride extending from the top edge of the rack to the bottom portion 80 and together with the anode shield 76 encloses the entire area of the anode that is not directly opposed to the cathodic face of the first bipolar electrode 10. Indeed, the current shield 76 which is located on the bottom and the sides of the face of the anode facing bipolar electrode 10, together with end wall 78 and bottom portion 80 form an anode chamber 82. This arrangement prevents current from passing around the sides and bottom of the anode toward the cathode 22. It should be apparent that essentially the only path for the current from the anode to the cathode is through the bipolar electrodes; thus, the problem of bypass current is substantially eliminated with the cell of the present invention.

Figure 4:
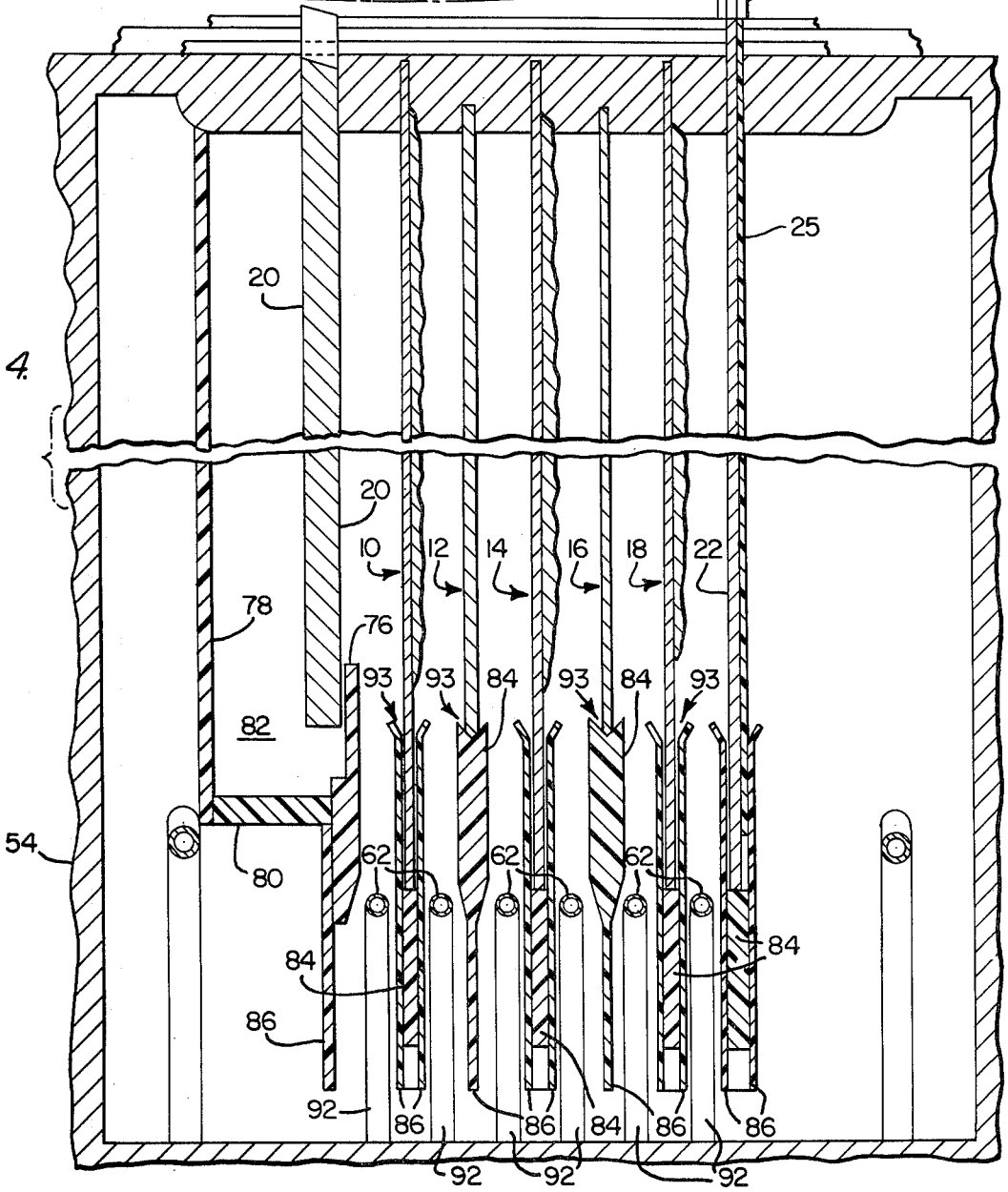
FIG. 4 is a sectional view taken along line 4—4 of FIG. 3.

Another advantage of current shield 76, used in conjunction with side shield/guides 88, is they may prevent the electrodeposition of metal on the edges of the bipolar electrodes. Thus, the shields confine the electrodeposition of the central portion of the appropriate face of the bipolar electrodes facilitating the removal of the deposited metal. As is shown in FIG. 4, each bipolar electrode is supported on the bottom by a support member 84. These bottom support members extend from side 56 to 57 and fix the bottom location of the bipolar electrodes in the cell. To provide the proper convection of the electrolyte, the cell is also inclusive of combination baffle/current shields 86 which also run from side 56 to side 57.

At this point it should be noted that the electrode bottom and side supports would normally be identical. Two types (solid/V-grooved and flexible/deep slotted) were provided to enable a variety of experimental electrodes to be employed while maintaining the same cross-section to series current flow. The cathode blanks and composite bipolar electrode were longer and wider than the all-copper bipolar electrodes.

The preferred and more practical type of support, which would be used with any bipolar electrode, is the solid/V-grooved.

The bipolar electrode guides 88 are fixed on the sides of electrolytic tank 54 for the entire length of the bipolar electrodes. These guides serve to position the bipolar electrodes and prevent the possibility of bypass current traveling along the sides of the cell from the anode to the cathode. They also prevent the electrodeposition of material on the edges of the bipolar electrodes to facilitate removal of deposited copper.

Important features in the process and apparatus which enable efficient high current density operation are the reduced bipolar electrode spacing and a novel convection system. Convection of the electrolyte in the system of the present invention is powered by gas agitation. Gas agitation is an old technique in the electrodeposition art. In the present invention, the convection system produces a fluidized sheet of relatively small, rapidly ascending gas bubbles that, together with the turbulence they create, result in vigorous mixing at the cathodic surface of the bipolar electrodes, where mixing is most needed. The convection system insures optimum deposition conditions such that the deposited metal is smooth and free of voids throughout all stages of its growth.

The gas agitation provides sufficient convection to prevent suspended particulates from lodging on the cathodic faces of the bipolar electrodes. Furthermore, the convection system avoids obstructions to electrolyte flow across the faces of the electrode and eliminates physical discontinuities of the cathodic surface such as edging and loops which cause entrapment and accretion of solids. These features are particularly advantageous in the case of electrorefining, where large quantities of anode slimes are generated in the cell. It has been found that, contrary to the teaching of the prior art, the anode slimes can be disturbed to an appreciable degree without incurring enhanced incorporation of impurities into the cathodic deposits. However, in order for this result to be achieved, the convection must be exceptionally vigorous and physical obstructions avoided, as is the case with the present invention. Similarly, in electrowinning, the present invention prevents incorporation of particulate impurities such as are derived from corrosion or erosion of the insoluble anodes. Thus, for example, electrowon copper of exceptional purity has been produced while employing conventional lead or lead alloy anodes in electrolytes which are corrosive to these anode materials.

The small bubbles are propelled into the electrolyte from bubble tubes 62 located beneath and between the bipolar electrodes. The air flow through the bubble tubes need not be large. For a ⅜ inch O.D. stainless bubble tube 15/1000ths to 20/1000ths inch wall thickness, a suitable orifice diameter is 6/1000th inch (6 mils) at an orifice spacing of ½ inch. However, a less suitable bubbler configuration may be employed if the desired improvement in current density and deposit quality is not as great.

The most suitable configuration of the bubbler comprises a rigid tube with a closely spaced (½ inch apart) round holes of diameter in the range of 5–7 mils. It has been found that bubble tubes having smaller diameter holes, e.g., 4 mils are not more efficient and are, moreover, more difficult to manufacture. It has also been found that bubble tubes with larger holes, e.g., 8 mils, expel an unnecessarily large volume of gas, or a comparable volume at a lower bubble velocity. An effective air flow is in the range of 1.5–2.0 SCFH per square foot of cathodic surface. This flow volume is equivalent to the rate of oxygen generation at an insoluble anode at an anodic current density of 135 to 180 ASF. It has been found that it is not so much the volume of air expelled as the total bubbler-tube/electrode configuration that determines the effectiveness of gas agitation. Lack of appreciation of this concept has probably retarded the more widespread application of gas agitation in large scale electrodeposition.

Although nitrogen has been used as the gas for agitation, air is preferred for reasons of economy whenever the ingress of atmospheric oxygen can be tolerated. When properly applied, air agitation becomes more, rather than less effective with decreasing face-to-face separation of electrodes, in contrast to other convection techniques known and practiced in the art.

To prevent the orifices from becoming crusted over with solidified solutes, the incoming air is presaturated with water vapor at a temperature close to that of the electrolyte. When this is done, the bubble tubes can be operated indefinitely without plugging of the orifices.

The invention provides that the bipolar electrode separation be at its practical minimum given the size of the bipolar electrode supporting means 84 and the clearance required for inserting and withdrawing of the electrodes. Together with the gas agitation, the reduced spacing provides the means of minimizing power consumption in the electrowinning or electrorefining process.

The baffles 86 serve to confine the bubble flow to the volume of electrolyte immediately adjacent to the bipolar electrode faces, thereby effecting the necessary concentration depolarization and uniform mass transport of metal ions to the cathodic faces. They also serve as bottom current shields.

The gas agitation method of the present invention also has favorable consequences for the anode reaction. In particular, in the electrorefining embodiment, not only is anode passivation fully forestalled, but the soluble anode metal is caused to corrode uniformly, thereby allowing a reduction in the amount of anode scrap. Improved efficiency is derived by substitution of bipolar electrodes having regular cross-section for the somewhat irregular bipolar electrodes cast by customary means.

Side walls 56 and 57 prevent distortion of the air "curtains" by interaction between rapidly ascending air bubbles and the induced circulation of electrolyte. When slipped into slots or grooves 93 on the inside walls of the rack, the electrodes form semi-isolated compartments which are open at the bottom.

At this point it should be noted that the gas bubbling actually pumps the electrolyte through the cell by an air-lift effect. The manner in which this pumping action occurs can be appreciated by arrows 90 shown in FIG. 5. With an initial electrolyte level just below the lowest edge 91 of side 56 of the rack, the upward convection created by the air bubbles pushes the electrolyte over the top edge 91 and down the side 56 of the rack. Of course, similar action occurs on the other side of the rack. The slots 92 on the bottom of the sides of the rack enable the pumped electrolyte to circulate throughout the cell in a continuous manner. The gas agitation system of the present invention induces an appreciable flow of electrolyte and maintains uniformity of electrolyte composition throughout an electrolytic cell of reasonable size. Indeed, the electrolyte composition is substantially the same, both within the cell and in the overflow represented by arrows 90.

In accordance with the present invention, a rack 52 was constructed with walls 56, 57 formed of 1-inch thick PVC. Because the ability to handle a variety of bipolar electrodes types was desired, for experimental purposes, the ultimate in close electrode spacing was not attempted. Rather, bottom members 84 spaced on 1.2-inch centers were affixed to the inner side walls of the rack. Bottom members 84 where joined by guides 88 affixed vertically to the rack as stated above, bottom members 84 and vertical members 88 were of two types: solid PVC slab with V-groove and flexible-walled, deep slots of PVC sheet.

The exterior dimensions of the rack is 39in. wide × 48in. high. The conveyable series rack had five intermediate, or bipolar positions. Of course, a commercial rack would accommodate many more bipolar electrodes. The retaining frames of the bipolar electrodes and the end cathode, as well as the gasketed frame against which the end anode pressed, defined a common cross-sectional area, for each electrode, of 32 in. × 38in. = 8.44ft$^2$ exposed to the electrolyte. Vertical slots 92 milled in the bottoms of the side walls accommodated the bubble tube manifold and located the tubes 4½ inch up from the cell bottom. There was one stainless steel bubble tube for each interelectrode volume; total air flow for the six tubes was about 1.2 SCFM.

Figure 6:
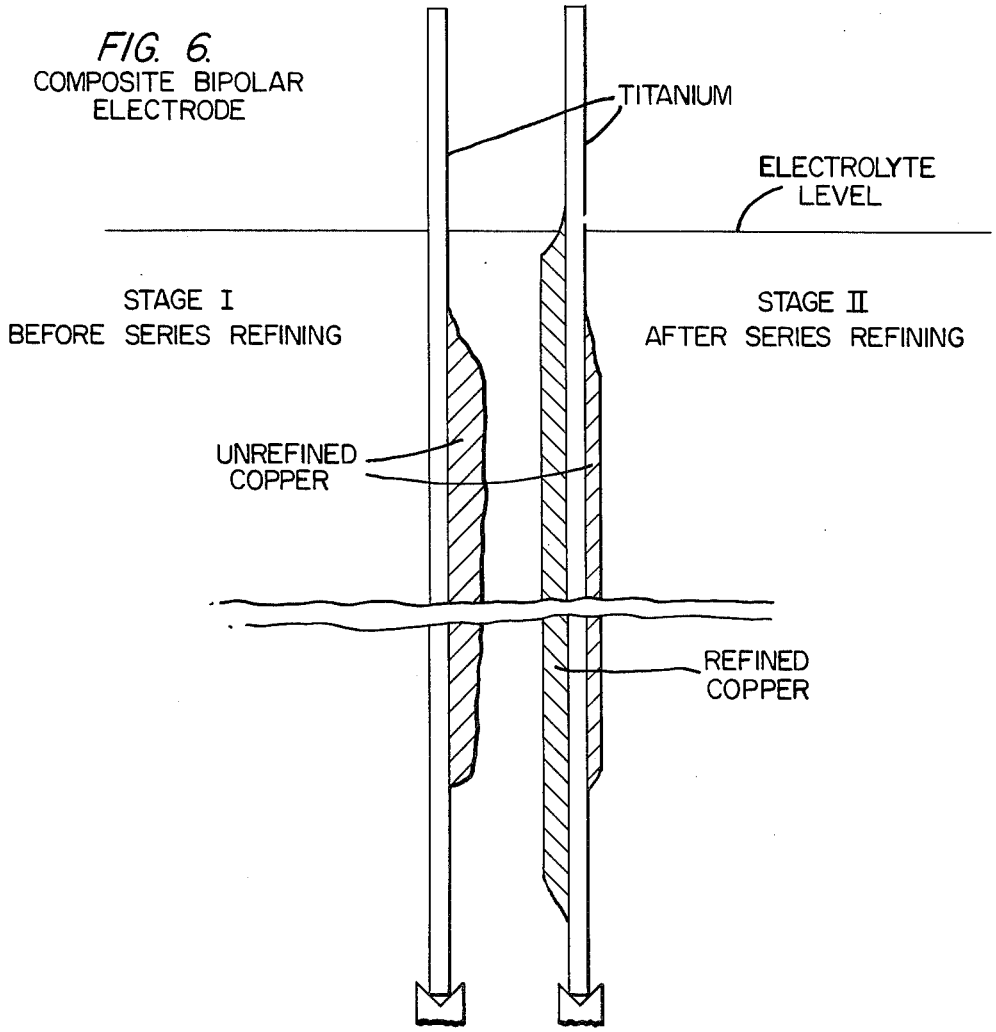
FIG. 6 is a sectional view of a composite bipolar electrode which can be used in the series electrorefining cell of the present invention; and, FIG. 7 is a diagram showing an experimental arrangement of electrodes for a combination high current density series electrowinning/electrofining, with letters distinguishing interelectrode compartments: *a*, *c*, *e*, designate electrowinning, *b*, *d*, *f*, designate electrorefining.

As has been set forth above, the cell of the present invention may advantageously employ composite bipolar electrodes. Such an electrode is best shown in FIG. 6.

With conventional bipolar electrodes such as electrodes 12 and 16, avoidance of a residue of impure metal to be separated, remelted and recast requires total immersion and either appreciable "over-refining'-'or unusually uniform current density distribution. The alternative approach is to apply a parting agent to the cathodic face and stop sufficiently short of complete refining to render practical the separation of refined from crude metal. Both tactics have inherent inefficiencies. Nonetheless, thin copper electrodes 16 without release agent and heavier copper electrodes 12 coated on one side with release agent were tested in our equipment and compared in performance with composite electrodes 10, 14 and 18 of the present invention.

The concept involved in the composite bipolar electrode structure is to employ as a base a sheet of electrochemically suitable material, such as titanium or niobium, and affix to it on one side a layer of anode metal such as copper. The refined metal deposited on the opposite face can be separated from the blank with relative ease because the cell prevents deposition at the edges of the cathodic surfaces.

The area of the layer of unrefined metal on a composite bipolar electrode may advantageously be made less than the immersed cathodic area, so that an ample margin of unplated blank results through the agency of the primary current distribution. Depending upon the method of application of the crude copper to the blank, a residue of unrefined copper can either be stripped for recycling or left as a base for another charge of crude copper.

It can be anticipated that if titanium or niobium or other chemically resistant "valve metal" were employed, current flow would virtually cease of its own accord when all of the anode copper had been dissolved. It has been found that substrates of stainless-steel/copper bipolar electrodes (S.S./Cu) also did not dissolve anodically, provided a large fraction of the anodic surface remained covered by copper. This observation attests to the low magnitude of polarization overpotential at copper anodes under air agitation.

There are at least five possible methods of fabricating the composite bipolar electrodes. These include (1) casting by either a blank-up or a blank-down procedure, (2) pressing, rolling or explosion-bonding to form a metallurgical bond between crude copper and blank, (3) fastening together as by bolts, rivets or clamps, (4) electrodepostion, and (5) simple stacking. The last-named method, with the plate of impure copper resting against the permanent blank, applies only to a horizontal or inclined disposition of electrodes.

Application of copper by electrodeposition (method 4) to form the composite bipolar electrode leads to double refining. For convenience, it was the method chosen for utlization in the example which follows but would obviously not be selected for plant operation unless double refining was the objective.

The titanium substrate for the single Ti/Cu bipolar electrode employed consisted of ⅛-inch sheet, 37½ inch in width. The side receiving the layer of "impure" copper was sandblasted in order to provide adequate retention, and the cathodic surface was abraded (400-grit paper) to prevent premature release of the deposit of refined copper.

The surface finish of Type 316 stainless steel as a substrate for copper electrodeposition is much less critical than for titanium. Success was experienced with ⅛-inch stainless sheets with 2B rolled finish and 3/16-inch stainless sheets with a ground and "polished" (with fine abrasive paper) finish. The stainless steel blanks were the same width as the titanium, and their length was 48 inches (The tops of both types of blank protruded above the electrolyte). The end negative electrode (cathode) was, for all runs, a blank of stainless steel.

Will all three varieties of composite bipolar electrode tested, no appreciable separation of the layer of copper to be refined occurred, even upon repeated immersion and removal from the hot electrolyte. The end positive electrode, as mentioned, was a commercial copper anode. Its presence, together with the vigorous mixing produced by the air agitation led to dispersal of anode slimes throughout the cell electrolyte. Hence, the electrodeposition conditions were more severe than for double electrorefining. Recirculation of electrolyte (space velocity about 1.15 $hr^{-1}$) through a filter maintained the concentration of suspended particulates at reasonable levels. The heavier slimes fraction collected on the bottom of the cell in the normal fashion.

In order to obtain experimental information on high intensity series electrowinning, copper and lead bipolar electrodes were positioned in alternation. For these studies, the end positive electrode was a perforated lead — 10% antimony anode of commercial design. Sheet lead and other insoluble anode materials have been utilized previously in series electrowinning; a recent development utilizes titanium bipolar electrodes having a conducting inert coating on the anode faces.

The invention is further illustrated by the following non-limiting examples.

EXAMPLE 1

Examples 1, 2, 3 each brought about the transfer of copper in amounts equivalent to approximately one-tenth conventional starter sheet thickness. This was effected in 30 min. at a nominal current density of 105 ASF. At the actual current of 875 amp. deposit weights for 100% cathodic current efficiency would be 1.14 lg, or approximately 0.003 inch in thickness. It is significant that the thin deposits so produced could in every case be stripped readily and intact from the stainless steel and titanium substrates. The heavier copper bipolar electrode 12, a 99-lb deposit from earlier high current density electrorefining, had its cathodic face coated with a parting agent (2 — benzothiazolethiol) but was not stripped until all preliminary experiments were completed. The lighter copper bipolar electrode 16 had been cut from 11-gauge commercial rolled sheet and weighed 36 lb initially; it did not receive a coating of parting agent, so that stripping was not an option.

Face-to-face electrode separations were measured on a 5 × 5 grid, and gave an average of 0,84 inch for the six compartments, with a range of 0.69 to 0.93. The variety of experimental electrodes employed is responsible for the relative nonuniformity in spacing. This nonuniformity, in turn, gave rise to measurable differences in the height of electrolyte in individual compartments during operation.

Electrolytic bypass current was responsible for relatively low cathode efficiency and was manifest in the deposition of copper along the bottom edge of the end cathode 22 and of the adjacent bipolar electrode 34 and over much of the exposed back surface of the end cathode. Some of the bypass current had been shunted through the stainless bubbler manifold, copper depositing where current entered and stainless steel becoming etched where current exited.

EXAMPLE 2

Following the first preliminary experiment, the end anode position was boxed in with PVC sheet (wall 78) so that, subsequently, with the end anode 20 in place, only the rectangular area defined by the gasketed frame opening could transmit current into the electrolyte. Correspondingly, the entire back of the end cathode was masked with PVC sheet 25 that was held in place with viinyl electrical tape. In addition, the baffles 86 were extended downward to 1 inch from the cell bottom. The manifold was reversed in position to enable detection of any new plating or etching on the manifold in this second preliminary experiment. As a direct consequence of those modifications, the time-average cell voltage (voltage integrator) was increased from 2.99 V to 3.43 V from Example 1 to Example 2.

EXAMPLE 3

The substantially reduced bypass current in Example 2 was essentially completely eliminated in Example 3 by further minor modifications to the bottom of the conveyable rack and by replacing the stainless steel manifold used in Examples 1 and 2 with one fabricated of PVC. Thereafter, the current path no longer intersecting any bubble tubes, they survived unscathed through the long series refining run.

In the third preliminary experiment, the time-average Their cell voltage was 3.46V, or 0.58V per anode-cathode pair, at approximately five times normal current density. Mean cathode efficiency and electrical power consumption were not distinguishably different for the second and third experiments. There values were 97% and 0.227 kwh/lb. The combined deposits on the heavy copper bipolar electrode 12 were found on stripping to weigh 3 lb 2½ oz; this corresponds to an overall cathodic current efficiency for that position of 92%.

Composite aqueous electrolyte samples taken from the cell at the beginning and end of each of the three short trials gave the following ranges of analyses (in g/l):

| | | | | | |
|---|---|---|---|---|---|
| Cu | 42–43 | Ni | 0.90 – 0.98 | As | 0.088 – 0.090 |
| $H_2SO_4$ | 153–157 | Fe | 0.27 – 0.30 | Sb | 0.047 – 0.049 |
| Slimes | 8–28 mg/l | Cr | 0.020 – 0.029 | Te | 0.0022 – 0.0024 |

Soluble tin, selenium and bismuth were 0.001 and 0.0005g/l, respectively. In addition, a single analysis for chloride ion in the holding tank at the conclusion of the preliminary experiments gave 30 mg/l. An instance of higher than usual suspended particulates, to a level of 54 mg/l, occurred on one occasion owing to a filter malfunction. Otherwise, the amounts of anode slimes in suspension were typical of commercial copper electrorefining.

EXAMPLE 4

For the full series refining run, the initial weights of copper were, reading left to right from the end anode:

| Electrode Reference No. | 20 | 10 | 12 | 14 | 16 | 18 | 22 |
|---|---|---|---|---|---|---|---|
| Wt. lbs. | 347 | 68 | 96 | 80 | 35½ | 65 | — |

Figure 1:
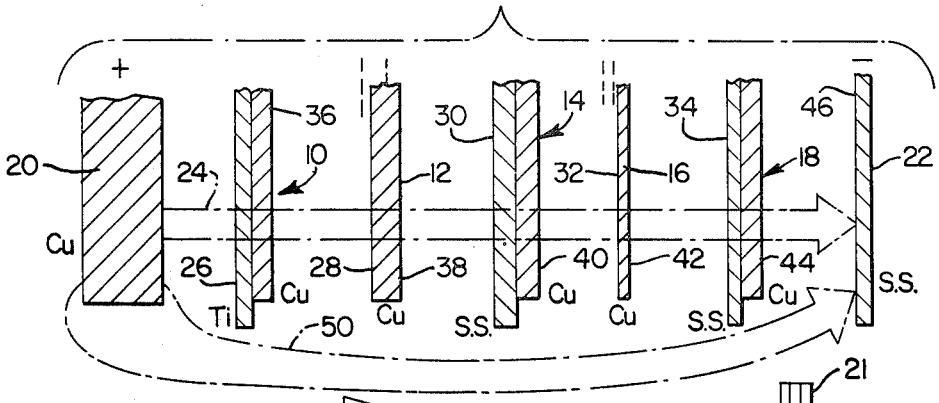
FIG. 1 is a diagram illustrating an electrode arrangement in an experimental series electrorefining cell.

In this example, the heavier copper bipolar electrode 12 was coated with release agent but the lighter copper bipolar electrode 16 which was to be "over-refined" was not. The current density was reduced from the nominal 105 ASF of the preliminary experiments to 84 ASF, thereby providing a safety margin against occurrence of bypass current in the much longer operation. Running time was 22¼ hours, calculated to transfer 40 lb of copper per electrode at 97% current efficiency. The pairs of vertical dashed lines in FIG. 1 show the approximates translation of the copper bipolar electrode surfaces.

Face-to-face electrode separation was measured as before and gave an average value of 0.85 inch, with a range of 0.77 to 0.89 inch. As a precaution against dissolution of the stainless steel blanks should their anodic sides become exposed to the electrolyte through removal of copper, vinyl electrical tape was applied to the anodic sides of the S.S./Cu composite electrodes 14 and 18 along the solution line. Tape was also applied along the bottom of the anodic face of bipolar electrode 18 for primarily the same reason. As it turned out, these precautions were unnecessary, for although some areas of stainless steel did become exposed along the top and bottom, the potential of the largely copper-covered surface did not become sufficiently positive to dissolve anodically the adjacent stainless steel.

One of the advantages of series electrolysis is that even at very high current densities bipolar electrodes can be pulled for inspection without disruption of the operation — no breaking and making of electrical contacts and no significant redistribution of the current. Indeed, the composite bipolar electrodes 18 and 14 were inspected once and two times, respectively, during the run to ascertain that the deposits were forming satisfactorily and that the substrates were not being attacked (there was no concern for the titanium substrate of electrode 10 on the latter score). Inspection of the stainless steel bubble tube array at the conclusion revealed no detectable interception of electrolytic current by that member.

It has been noted that the usual triangular bar to suspension bar contacts need to be bolstered for very high current density operation. Low-resistance contact clamps were employed for the end electrodes and the following voltage drops during steady-state operation at 84 ASF (709 amps actual average current) were measured:

| | |
|---|---|
| cathode bus bar to cathode suspension bar, near end | 4.6 mV |
| cathode bus bar to cathode suspension bar, far end | 18.6 mV |
| anode bus bar to near anode lug | 5.0 mV |
| anode bus bar to far anode lug | 9.0 mV |

Average voltages between adjacent electrodes, measured at intervals during the run were (beginning with the end anode vs Ti/Cu combination): 0.548, 0.421, 0,462, 0,447, 0.410, 0.503. These sum to 2.79 V which, on adding the potential differences across the end contacts, comes very close to the time-average integrated cell voltage, namely 2.797 V.

During the long series refining run, electrolyte was continuously recirculated at 3 GPM, with a superposed flowthrough rate of 1 GPM to offset copper buildup. Analyses of conposite electrolyte samples taken from the several interelectrode compartments gave the following results:

| Time | Cu, g/l | $H_2SO_4$, g/l | Slimes, mg/l |
|---|---|---|---|
| Start | 43.4 | 155 | 19.6 |
| Midway | 45.9 | 154 | 18.0 |
| End | 47.6 | 152 | 16.5 |

The increase in copper concentration with time is due to the greater anodic current efficiency as compared to the cathodic and to evaporative loss of water from the system. The trend toward decreasing sulfuric acid concentration must be due to a combination of consumption by reaction with oxide in the impure anode ($Cu_2O + 2H^+ \rightarrow Cu + Cu^{2+} + H_2O$) and by the general copper corrosion reaction ($Cu + 2H^+ + \frac{1}{2} O_2 \rightarrow Cu^{2+} + H_2O$). It will be noted that a. the vigorous mixing of electrolyte distributed the suspended slimes from the single crude copper anode to something like the probable level of commercial electrorefining practice and that b. filtration in the recirculation loop at the indicated rate was sufficient to offset buildup of the amount of slimes in suspension.

Weight changes and current efficiencies for the long run at 84 ASF are listed in Table 1.

TABLE I.

HIGH CURRENT DENSITY SERIES ELECTROREFINING (84 ASF; 46 g/l Cu; 154 g/l $H_2SO_4$; 60° C)

| Electrode | Spacing, in. | Weight Change, lb | Current Effeciency % Measured | Current Effeciency % Probable |
|---|---|---|---|---|
| (+) Cu - No. 20 | | −43.3 | 105.0 | 103 |
| | 0.70 | | | |
| Ti/Cu - No. 10 | | +41.09 | 99.6 | 98 |
| | | −43.06 | 104.4 | 102.5 |
| | 0.94 | | | |
| *Cu - No. 12 | | +40.45 | 98.1 | 96.5 |
| | | −42.16 | 102.2 | 100.5 |
| | 0.86 | | | |
| S.S./Cu - No. 14 | | +41.09 | 99.6 | 98 |
| | | −42.81 | 103.8 | 102 |
| | 0.77 | | | |
| Cu - No. 16 | | − 1.12 | — | — |
| | 0.90 | | | |
| S.S./Cu No. 18 | | +40.96 | 99.3 | 97.5 |
| | | −42.67 | 103.5 | 102 |
| | 0.88 | | | |
| (−) S.S. - No. 22 | | +41.52 | 100.7 | 99 |

*Parting agent applied.

EXAMPLE 5 AND 6

Series Electrowinning

Figure 7:
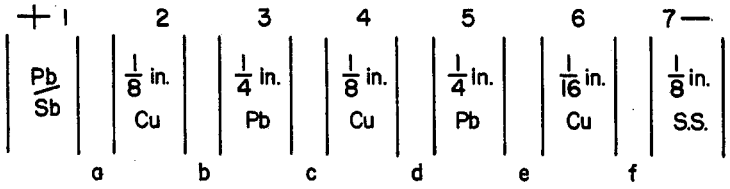

The arrangement of electrodes for the high-tensity series electrowinning study is shown in FIG. 7. Including the commercial lead/antimony end anode, the cell combined three insoluble and three soluble anodic surfaces.

A single preliminary experiment was carried out to confirm that bypass current was still small at the higher cell voltage required for series electrowinning. By raising the current density in stages (of 21 ASF), it was established that the power supply had adequate output for 84 ASF operation, i.e. the same current density as was employed for the series refining. The subsequent run was conducted at 84 ASF, so that measured electrical quantities could be corrected for the presence of the three soluble bipolar electrodes.

The same electrolyte as used in the series electrorefining experiments, fed to the cell with about 46 g/l Cu and 156 g/l $H_2SO_4$, exited the cell at about 36 g/l Cu and 169 g/l $H_2SO_4$. Owing to the vigorous mixing, there was no significant or systematic difference in copper concentration on comparing electrowinning compartments with electrorefining compartments and with the discharge over the weir. Electrolyte recirculation was carried out continuously through a 10-micron filter at about 3.5 GPM. Flow-through rate was 2 GPM in the Example 5 and 1.1 GPM in Example 6. The concentration of soluble As, Sb, Bi, Se, Te and Sn were the same as given above for the solution while it was being used as an electrorefining electrolyte. Additional analytical information concerning the electrowinning electrolyte is contained in Table II.

TABLE II.

ELECTROLYTE COMPOSITIONS: SERIES ELECTROWINNING (6½ HRS 60° C)

| | g/l Cu | g/l $H_2SO_4$ | mg/l slimes |
|---|---|---|---|
| Holding tank (feed to cell) * | 46.1 | 156 | — |
| Cell electrolyte, start | 32.6 | 169 | 12.8 |
| Electrowinning compartment a, 3¼ hr. | 34.4 | 170 | — |
| + Electrowinning compartments, 3¼ hr. | 35.4 | 169 | 17.6 |
| No. Electrorefining compartments, 3¼ hr. | 35.5 | 170 | 16.3 |
| Weir discharge, 3¼ hr into run | 35.6 | 169 | — |
| + Electrowinning compartments, end | 35.9 | 170 | 23.2 |
| No. Electrorefining compartments, end | 36.4 | 169 | 24.7 |
| Weir discharge, end of run | 35.9 | 169 | — |
| Composite cell effluent | 35.0 | 169 | — |

* 1.00 g/l Ni, 0.29 g/l Fe, 0.024 g/l Cr
+ Compartments a, c and e: composite sample
No. Compartments b, d and f: composite sample In Example 5, the steady cell voltage was approached in four 59 A·h stages. The resuls were:

| | | | | |
|---|---|---|---|---|
| Current density, ASF | 21 | 42 | 63 | 84 |
| Duration, minutes | 20 | 10 | 6.7 | 5 |
| "Steady" cell voltage | 6.15 | 7.15 | 7.9 | 8.7 |

Extrapolation of the above voltages yields 5.4 ± 0.2 V as the voltage at zero current, with surfaces of copper and anodically oxidized lead. Dividing this by three for the three electrowinning sub-cells and subtracting the thermodynamic emf of a cell composed of an oxygen hydrogen ion and a copper + cupric ion electrode (0.86 V at 60° C), one obtains 0.9–1.0 volt for the average oxygen overpotential on the sheet-lead anodes and perforated lead-antimony anode employed.

In addition to providing assurances that the current shielding was adequate for the high cell voltage appropriate to series electrowinning, Example 5 revealed the inadequacy of the surface treatment of the lead bipolar electrodes. Accordingly, prior to the long run of Example 6, their cathodic surfaces were abraded with emery paper and fine steel wool followed by chemical cleaning. The latter operation consisted of pickling with a mixture of acetic acid and hydrogen peroxide followed by an alcohol rinse. The subsequently produced copper deposits were of starter sheet thickness and were entirely coherent, although there were local areas of apparent premature release from the lead substrate.

The copper bipolar electrodes in positions 2 and 4 in FIG. 7 were ⅛-inch thick rolled copper salvaged from old starter sheet blanks and weighed approximately 73 lb each; position 6 was occupied by a sheet of commercial rolled copper weighing 46 lb. Weight changes, cathodic current efficiencies and other pertinent information are included in Table III. Owing to the use of less bulky electrodes as compared to the series electrorefining experiments, the average face-to-face spacing was 1.05 inch (cf. 0.85 inch average for the series refining).

At an average current of 733.5 amp for 6.50 hr (86.9 ASF based on 8.44 $ft^2$ projected area), the integrated average cell voltage was 7.963 V. (The sum of directly measured interelectrode voltages in Table III is 7.91 V). Considering that the position 6 to 7 face-to-face spacing, and using the average of the measured corresponding potential differences namely, 0.485 V, the average voltage of an electrowinning sub-cell can be estimated at ⅓ (7.963 − 3 × 0.485) = 2.17V. This value, as may be seen, is satisfactorily close to the single directly measured voltage (compartment e). Thus, we calculate a series electrowinning power consumption of 2.17 V × 4.768 kAh ÷ 12.03 lb, = 0.85 kwh/lb, a factor of about 4 greater than for series refining at the same current density and face-to-face spacing.

The data of Table III show a discernible trend toward diminished cathode current efficiency on moving toward the center of the cell. This bespeaks a certain amount of current passing by the interior electrodes, an explanation corroborated by the appearance of the bubble tubes, which had acquired some lightly etched and some lightly plated portions. Some of the electrolytic bypass current had evidently been shunted through the bubbler array, the positive current entering tubes at the anodic end of the cell, exiting at the elbows, re-entering through elbows at the opposite end and re-emerging into the electrolyte from the corresponding tubes. Adequate elimination of bypass current in high current density winning imposes severe constraints on design and construction of cell components.

TABLE III.

HIGH CURRENT DENSITY SERIES ELECTROWINNING (86.9 ASF; 35 g/l Cu; 169 g/l $H_2SO_4$; 60° C)

| Electrode | Spacing in. (approx.) | Voltage, V | Weight Change, lb | C.E., % |
|---|---|---|---|---|
| (+) Pb/Sb | | 2.69 | — | — |
| Cu | 1.2 | | −0.47 | — |
| Pb | 1.0 | | +12.02 | 96.5 |

TABLE III.-continued

| HIGH CURRENT DENSITY SERIES ELECTROWINNING (86.9 ASF; 35 g/l Cu; 169 g/l $H_2SO_4$; 60° C) | | | | |
|---|---|---|---|---|
| Electrode | Spacing in. (approx.) | Voltage, V | Weight Change, lb | C.E., % |
| Cu | | 2.54 | | |
| | 1.0 | | −0.63 +11.78 | 94.6 |
| | 1.0 | | −12.41 | 99.6 |
| Pb | | | +11.99 | 96.2 |
| | $1.0_3$] | 2.19 | | |
| Cu | | | −0.53 | |
| | $1.0_7$] | 0.49 | | |
| (−) S.S | | | +12.31 | 98.8 |

Metallography and Electrode Purity

Interesting structures result from refining of bipolar electrodes. As illustration, referring to the residue of unrefined coper at the edge of the copper sheet that had been in position 5 during the long series refining run, the body of that sheet has been completely replaced by new copper. In contrast to the fine-grained residue of rolled copper, the cathodically deposited copper has the coarse grain structure typical of high current density operation when addition agents are absent from the electrolyte. Coarse-grainedness notwithstanding, the chemical purity of this and other cathodically deposited copper produced in accordance with the present invention is satisfactorily high, as indicated by the analytical data of Table IV. The low concentration of incorporated impurities is consistent with the seeming absence of voids.

TABLE IV.

SEMIQUANTITATIVE* MASS SPECTROGRAPHIC ANALYSES OF COPPER DEPOSITS (PARTS PER MILLION BY WEIGHT)

| ppm | avg. | range | ppm | avg. | range | ppm | avg. | range |
|---|---|---|---|---|---|---|---|---|
| B | 0.09 | (0.03–0.2) | Ca | 1 | (0.2–2) | As | 0.08 | (0.03–0.1) |
| Si | 4 | (1–10) | V | 0.1 | (0.1–0.2) | Ag | 6 | (2–15) |
| P | 0.1 | (0.02–0.2) | Cr | 0.3 | (0.05–1) | Sn | 0.06 | (N.D.–0.06) |
| Cl | 3 | (1–5) | Mn | 0.09 | (0.03–0.2) | Sb | 0.1 | (0.04–0.4) |
| K | 1 | (N.D.–2) | Fe | 0.6 | (0.2–1) | Pb | 0.2 | (0.03–0.7) |

*Reliability range about one order or magnitude; e.g., 0.3ppm could be as large as 1 or as small as 0.1ppm.
N.B. Ni not measurable for most samples (detection method not sensitive for this element).

In addition to the anticipated blockage of electrolytic current within the V-groove, there was a net reduction in volume of the copper at the ends of the bipolar electrode. The locally larger than average ratio of anodic to cathodic current efficiency seems to be characteristic of the mode of series electrolysis employed. Thus, the top edges of all deposits were tapered, and exposed sections next to slots were thinned. This is evidence of a certain non-uniformity of current density distribution, in particular, an enhancement of anodic current density at peripheral regions. All factors considered, shallow grooves are probably preferable to deep slots for holding conventional bipolar electrodes.

CONCLUSION

In series refining with freely suspended electrodes, serious degradation of current efficiency seems inevitable, even at normal low current densities. This is because the usual losses due to contact shorts are augmented by diversion of some cell current around immersed edges of the bipolar electrodes. Results of the present invention show that a combination of positive positioning and insulating barriers can be so reduced these effects that high current density series refining becomes attractive and even high current density electrowinning becomes feasible.

Details of cell component construction are more critical for series electrowinning, but even that can be carried out at elevated current density with good efficiency. A preferred feature of design is the provision of openings in the bottom of the integral electrode enclosure. The openings are necessary to permit circulation of electrolyte and, in electrorefining, especially, to make possible the setting out of suspended particulates (in zones of low convection).

Complete enclosure of the interelectrode spaces at the sides as advocated in early patents requires improved convection in order to maintain cathode quality.

Fortunately, air agitation in accordance with the present invention becomes increasingly effective with diminished face-to-face spacing, with the presence of peripheral convection baffles. The conveyable series rack of the present invention thus provides a configuration that is advantageous on several counts, including the minimization of electrical power consumption and greater protection afforded to the bubble tubes.

Titanium or other suitable valve metal is preferred over stainless steel as the backbone material of the composite electrode of this invention. The main reason for this preference is that, with the former, anodic oxide formation constitutes a fail-safe mechanism against anodic dissolution, should the blank become exposed to the electrolyte through loss of the copper layer by whatever means.

The conditions under which the series electrorefining and electrowinning were carried out were well within the capability of the air agitation technique in terms of producing smooth and dense deposits. Thus, the ratio of cathodic current density to effluent copper concentration was about 1.8 ASF/gpl and 2.5 ASF/gpl, respectively, whereas for the same relatively "clean" $CuSO_4/H_2SO_4$ electrolyte at 0.60° C, the capability index has been shown to exceed 5 in the same units.

Finally, the method and apparatus for series copper electrorefining and electrowinning of the present invention are intrinsically capable of even lower electrolytic power requirements than were encountered in the examples. In general, by dispensing with current-carrying suspension bars for all intermediate electrode positions, the physical limitation of the closeness of spacing is removed. The limiting factors than become electrode planarity and alignment and the ability to produce smooth and dense deposits.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therein intended to be embraced therein.

We claim:

1. A process of performing series electrodeposition of metals at a high current density while reducing bypass current comprising:

a. providing a conveyable rack formed of a non-conductive material and including a pair of sidewalls having slots on the bottom extending through the sidewalls to allow fluid flow through the sidewalls, the conveyable rack also being provided with nonconductive bottom support members extending between and secured to each sidewall between the slots, the conveyable rack also being provided with nonconductive electrode guides on the side of the rack in line with the bottom support members, the length of the nonconductive electrode guides being sufficient to extend the entire submerged length of a bipolar electrode is placed in the rack with the rack in a tank containing an electrolyte, said rack also being provided with a means for shielding an anode to prevent current from passing along the side, bottom and back of the anode toward the cathode when an anode and cathode are in the rack during electrodeposition;

b. positioning within the conveyable rack, at a location remote from an electrolytic tank,
   1. an anode so that it is within the means for shielding the anode so that current cannot pass along the sides, bottom or back of the anode toward the cathode during electrodeposition,
   2. a cathode, and
   3. a series of bipolar electrode between the anode and the cathode so that the bottom of each bipolar electrode is supported by a nonconductive bottom support member and each side of each bipolar electrode is within a nonconductive electrode guide;

c. conveying the conveyable rack which has been loaded in step (b) with an anode, a cathode and bipolar electrodes to an electrodeposition tank containing an electrolyte to form an electrodeposition cell; and, d. electrodepositing metal on the cathodic faces of the bipolar electrodes and the cathode while generating sheets of ascending bubbles of gas from bubble tubes positioned between and below the bipolar electrode to continuously circulate electrolyte over the top of the rack, down the side of the rack and through the slots, the bottom support members and electrode guides forming compartments within the cell which minimize lateral spreading and contraction of the sheet of bubbles and reduce the possibility of bypass current.

2. The process as set forth in claim 1 wherein in step (b) (1) a soluble anode is provided and in step (b) (3) the bipolar electrodes that are provided are prepared by affixing a layer of anode metal to a substrate.

3. The process as set forth in claim 2 wherein in step (b) (1) an insoluble anode is provided and in step (b) (2) an insoluble bipolar electrode is provided.

4. The process as set forth in claim 1 wherein in step (d) sheets of air bubbles are generated from a flow of air in the range of 1.5–2.0 standard curbic foot per hour per square foot of cathodic surface.

5. The process as set forth in claim 4 wherein the air is presaturated with water vapor at a temperature close to that of the electrolyte.

6. The process as set forth in claim 1 including the steps of removing the conveyable rack from the electrolytic tank after metal has deposited on the cathodic faces of the bipolar electrodes and the cathode, and, removing the bipolar electrodes from the rack to enable the metal deposited thereon to be removed.

7. The process as set forth in claim 1 wherein in step (b) (1) a copper anode is provided and in step (d) copper metal is electrodeposited on the cathodic faces of the bipolar electrodes and the cathode at current densities in excess of 17 amps per square foot.

8. The process as set forth in claim 1 wherein step (b) (1) a copper anode is provided and in step (d) copper metal is electrodeposited on the cathodic faces of the bipolar electrodes and the cathode at current densities in excess of 20 amps per square foot.

9. The process as set forth in claim 1 wherein the electrolytic tank is provided with cathode current supply bars and anode current supply bars and the conveyable rack is conveyed in step (c) to the tank in a manner so that the cathode contacts the cathode supply bars and the anode contacts the anode supply bars while no bipolar electrode makes any direct electrical contact with either the cathode or anode supply bars.

* * * * *